United States Patent [19]

Blum et al.

[11] 4,204,706

[45] May 27, 1980

[54] METHOD AND MULTI-LAYER LABEL HAVING PRESSURE-SENSITIVE MARK TRANSFER SYSTEM

[76] Inventors: Julian J. Blum, 7211 N. 3rd St., Phoenix, Ariz. 85020; Don J. W. Thralls, 336 W. Gardenia, Phoenix, Ariz. 85021

[21] Appl. No.: 921,726

[22] Filed: Jul. 3, 1978

[51] Int. Cl.[2] ..... A44C 3/00

[52] U.S. Cl. ..... 283/21; 40/2 R

[58] Field of Search ..... 40/2 R; 283/21

[56] References Cited

U.S. PATENT DOCUMENTS

| | | | |
|---|---|---|---|
| 2,671,678 | 3/1954 | Walsh | 40/2 R X |
| 2,767,495 | 10/1956 | Harris | 40/2 R |
| 2,979,840 | 4/1961 | Eastman | 40/2 R |
| 3,153,868 | 10/1964 | Jones | 40/2 R |
| 3,197,899 | 8/1965 | Twentier | 40/2 R X |
| 3,252,234 | 5/1966 | Goodman | 40/2 R |
| 3,931,426 | 1/1976 | Brown et al. | 40/2 R X |
| 3,947,983 | 4/1976 | Brunette | 40/2 R X |
| 4,121,856 | 10/1978 | Brunette | 283/21 X |
| 4,121,961 | 10/1978 | Brunette et al. | 283/21 X |

*Primary Examiner*—Paul A. Bell

*Attorney, Agent, or Firm*—Cahill, Sutton & Thomas

[57] ABSTRACT

A multi-layer labeling system is disclosed including a label having an adhesive coated back surface adhesively mounted on an inside surface of a removable backing sheet. An adhesive coated inside surface of a transparent overlay is adhesively attached to an exposed edge of the inside surface of the backing sheet and an adjacent edge of the label. A removable separator sheet is adhesively attached to a portion of the inner surface of the transparent overlay. The removable separator sheet includes a spot carbonized portion; the inner surface of the removable separator sheet nonadhesively lies against an information surface of the label. Pressure may be applied to the outer surface of the transparent overlay without unfolding the multi-layer label system. Marking pressure applied to the carbonized area causes the transfer of a mark from the carbonized area to the information surface of the label. The removable separator sheet is then peeled away from the transparent overlay, exposing the adhesive coating of the inside surface of the transparent overlay. The transparent overlay is then pressed against the label, and adhesively adheres thereto. The removable backing sheet is then peeled from the multi-layer label system, exposing the adhesive coated surfaces thereof. The multi-label system is then adhesively attached to a chosen surface.

8 Claims, 7 Drawing Figures

METHOD AND MULTI-LAYER LABEL HAVING PRESSURE-SENSITIVE MARK TRANSFER SYSTEM

BACKGROUND OF THE INVENTION

1. Field of the Invention

The invention relates to labels, and more particularly, to multi-layer labeling systems incorporating pressure-sensitive adhesives and transparent protective overlays.

2. Description of the Prior Art

Labels having pressure-sensitive adhesive coatings are well known. A great variety of such labels exist in the prior art. However, in many instances it is desirable to utilize a gummed or self-adhering label and to provide a covering for the label after it is adhesively applied to a chosen surface. For example, it is frequently desirable to mark desired information on a label, place the label on a mounting surface, and then cover the label with an adhering transparent cover or overlay to prevent defacement or destruction of the label through subsequent use. Such transparent overlays are particularly useful in moist environments, wherein it is desirable to protect the marked information of the label from smearing due to the intrusion of moisture during use of the label.

The use of prior labeling systems with transparent coverings or overlays has required that gummed labels or labels having pressure-sensitive adhesive thereon be appropriately marked, placed on a supporting surface, and covered with a clear coating or clear plastic layer. Thus, multiple operations are required in utilization of such prior art labeling systems. Further, careful alignment of the transparent overlay over the label after a label is attached to the desired supporting surface is required to ensure that the label is completely covered and protected. Use of known multi-layer labeling systems is inconvenient; thus, there is an unmet need for more conveniently deployable multi-layer label systems.

SUMMARY OF THE INVENTION

Accordingly, it is an object of the invention to provide a multi-layer labeling system that may be utilized in environments requiring a clear protective covering over an information surface of the multi-layer labeling system.

It is another object of the invention to provide a conveniently deployable multi-layer labeling system that inherently provides proper alignment of an information surface and a clear convering layer.

It is yet another object of the invention to provide a multi-layer labeling system incorporating pressure-sensitive adhesive coated information layers and transparent layers.

It is yet another object of the invention to provide a multi-layer labeling system incorporating pressure-sensitive adhesive layers and a transparent covering layer inherently providing proper alignment to a label wherein a selected mark can be produced on the label without folding back on the transparent covering layer.

Briefly described, and in accordance with one embodiment thereof, the invention provides a multi-layer label system having a transparent overlay, a label having an information surface, and a pressure-sensitive marking means producing marking of the information surface in response to applying marking pressure on an outside surface of the transparent overlay. The label has an adhesive back surface releasably adhering to a removable back sheet which extends beyond the edges of the label. An adhesive coated inside surface of the transparent overlay is adhesively attached to an extending edge of the releasable back sheet and an adjacent edge of the information surface of the label. A removable separator sheet has an outer surface releasably adhering to the inside surface of the transparent cover sheet. In one embodiment of the invention, the pressure-sensitive marking means includes a print producing medium on the inner surface of the removable separator sheet for producing desired marks upon the information surface of the label in response to the marking pressure applied to the outer surface of the transparent overlay. After the marking pressure has been applied to produce the desired markings on the information surface, the transparent protective cover and removable separator sheet are folded back from the information surface. The removable separator sheet then is peeled away from the inner adhesive coated surface of the transparent overlay. The adhesive coated inner surface of the overlay is pressed against the information surface. The removable back sheet is peeled away from the back surface of the label. The multi-layered labeling system is then affixed to a chosen surface. Alternately, the separator sheet can be removed after the multi-layered label is affixed to the chosen surface.

DESCRIPTION OF THE INVENTION

Figure 1:
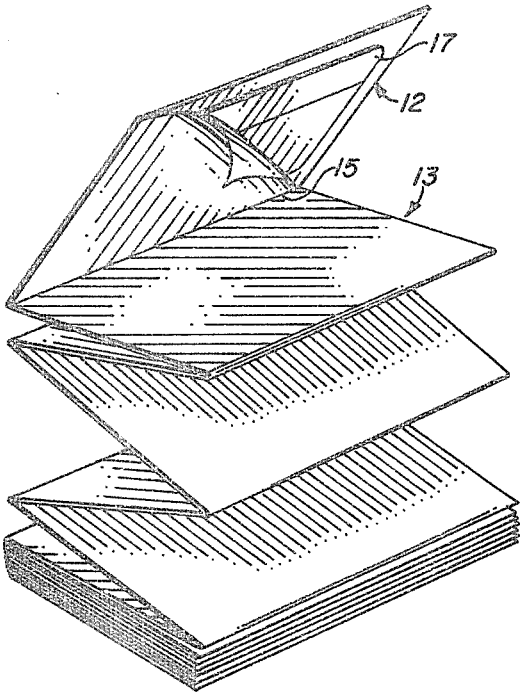
FIG. 1 is a perspective view of a plurality of multi-layer label systems, each connected to another by perforations in a releasable continuous supporting back sheet.

Referring now to the drawings, and particularly to FIG. 1, a "stack" of multi-layer label systems including label systems 12 and 13 is shown. Each multi-layer label system is connected to the next by means of a perforated fold, such as the one designated by reference numeral 15. The illustrated stack is a convenient configuration for manufacturing, storing, and marking the multi-layer label systems of the invention.

Figure 2:
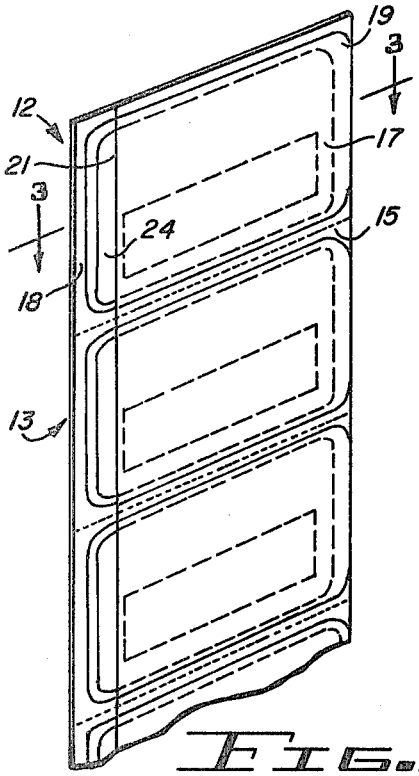
FIG. 2 is a perspective view of several of the multi-layered labels of the invention.
Figure 4:
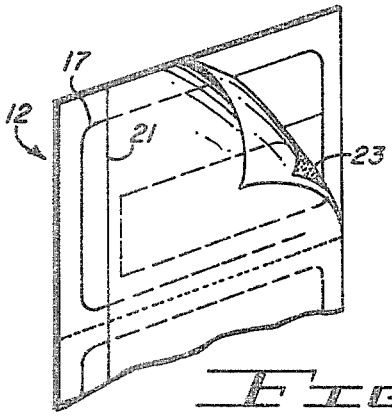
FIG. 4 is a perspective view illustrating a portion of a mark producing medium of the invention on the underside of the separator sheet.
Figure 3:
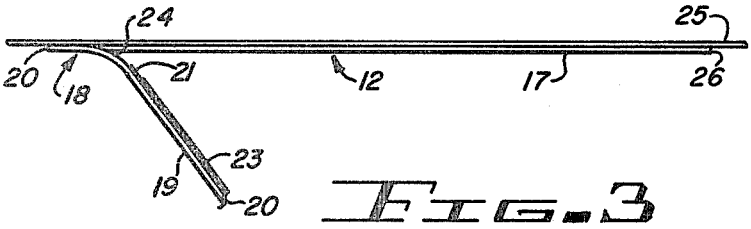
FIG. 3 is a sectional view taken along section lines 3—3 of FIG. 2.

Referring now to FIGS. 2, 3, and 4, all of the multi-layer label systems are identical prior to application of marking pressure thereto. Multi-layer label system 12 includes a label 17 releasably mounted on a back sheet 25. Back sheet 25 extends beyond the edges of label 17 in all directions. Back sheet 25 may be composed of wax or silicone treated paper, while label 17 may be composed of self-adhesive white sulfite paper.

Figure 5:
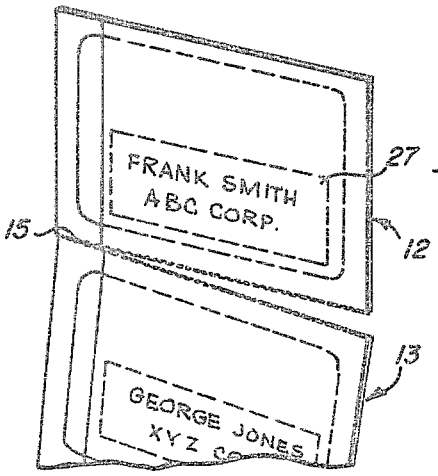
FIG. 5 is a perspective view illustrating separation of several multi-layer label systems after removal of the respective separator sheets and sealing of the transparent covering sheets to the respective multi-layer label systems.

As indicated in FIG. 2, a continuous back sheet forms all of the individual back sheets of the respective label assemblies. The individual removable back sheets, such as 25, are separated from the others by means of perforations, such as those designated by reference numeral 15. The individual assemblies can be separated by tearing along perforations 15, as indicated in FIG. 5, before or after the appropriate information has been produced on the information surfaces of the respective labels.

Referring now particularly to FIGS. 2 and 3, multi-layer label assembly 12 includes a transparent plastic overlay 19 adhesively attached to exposed edge strip area 18 of removable backing sheet 25 extending beyond the edge strip area 24 of label 17. The entire inner surface of plastic overlay 19 is adhesive coated. Plastic overlay 19 may be formed of self-adhesive mylar. The underside of plastic overlay 19 is further adhesively attached to edge strip area 24 of the upper surface of label 17. The remaining adhesive area of the inner surface of plastic overlay 19 adheres to removable separator sheet 21. Removable separator sheet 21 may be formed of wax paper. The remaining exposed portion of the upper surface of label 17 is hereinafter referred to as the information surface.

It should be noted that the term "pressure-sensitive adhesive", as used herein, is intended to include conventional tacky coatings typically used on paper products to permit the user to secure one sheet of paper or film to another. Similarly, the term is also intended to include equivalent adhesives, such as conventional gummed surfaces, whether pre-moistened or not.

In accordance with the present invention, at least a portion of the underside of removable separator sheet 21 includes or is coated with pressure-sensitive marking material. The pressure-sensitive marking material responds to a marking force applied to the outside surface of transparent plastic overlay 19 to cause corresponding marks to appear on the information surface of label 17, thereby eliminating the requirement that plastic overlay 19 be folded back to permit typing or marking of information on the information surface.

A system similar to the present one is disclosed in my copending U.S. patent application Ser. No. 833,474, filed on Sept. 15, 1977, and incorporated herein by reference. The multi-layer label system of the copending application requires that plastic overlay 19 be folded back before marking the information surface.

In one embodiment of the invention, at least a portion 23 of the undersurface of the removable separator sheet is "spot carbonized" or "inked", so that when marking pressure is applied to the outer surface of plastic overlay 19 (when it lies flat against label 17, as shown in FIG. 2), a corresponding ink mark is produced on the information surface of label 17.

The individual removable separator sheets 21 may be formed from a continuous sheet, and may be separated from each other by perforations, also designated in the drawings by reference numeral 15.

FIG. 4 more clearly shows a "spot carbonized" portion of the undersurface of removable separator sheet 21. Instead of spot carbonizing the undersurface of removable separator sheet 21, both separator sheet 21 and the information surface of label 17 can be formed of pressure-sensitive papers which cooperate to produce dark marks on the information surface in response to the marking pressure transmitted to the information surface via the pressure-sensitive paper included in or positioned between the information surface and the underside of removable separator sheet 21. The marking pressure may be produced by various marking devices, such as a sharp tipped pencil-like device or a typewriter adjusted to type stencils. A suitable type of pressure-sensitive paper is commonly referred to as "NCR paper".

Figure 6:
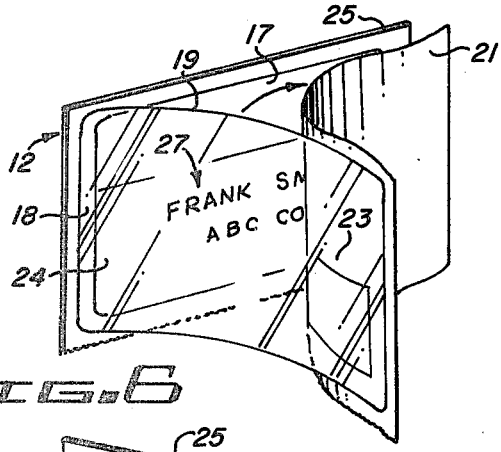
FIG. 6 is a perspective view illustrating removal of a separator sheet and pressure-sensitive mark producing medium.

After the marking pressure has been applied to produce the desired pattern on the information surface of label 17, plastic overlay 19 is folded back, and separator sheet 21 (and the pressure-sensitive mark producing medium thereof) are peeled away from the adhesive underside of plastic overlay 19, as indicated in FIG. 6.

The multi-layer label system of the present invention is easily manufactured in mass quantities, and is easily handled during shipping. Information is easily marked on the information surface of the labels because the plastic overlay does not need to be folded back to permit direct marking on the information surface. Instead, an entire stack of connected individual multi-layer label systems can be (for example) inserted into a typewriter adjusted to type stencils. The desired information can be "typed" on the outside of the protective plastic overlay. The removable separator sheets then can be removed and the plastic overlays can be adhesively sealed to the information surfaces with no manual alignment. In short, the multi-layer label assemblies of the invention are more convenient to use than any known label assembly which provides a transparent protective cover for sealing the information surface of the label from moisture and dirt. All of the separate multi-layer label systems in "stack" 10 of FIG. 1 can be marked, for example, by feeding stack 10 into a typewriter and typing desired information on each multi-layer label system. The individual label systems (such as 12 and 13) then can be separated by tearing them apart along the perforated lines indicated by reference numeral 15 as indicated in FIG. 5.

Figure 7:
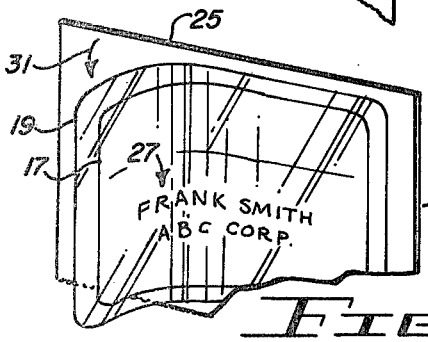
FIG. 7 is a perspective partial view illustrating removing of the releasable backing from a multi-layer label system.

The adhesive coated inner surface of transparent overlay 19 then is pressed onto the information surface of label 17 and the exposed portion of the inner surface of back sheet 25. After removable separator sheet 21 has been removed, removable back 25 may be separated from the label 17 as illustrated in FIG. 7.

The final step, not indicated in the drawings, is mounting the multi-layer label system (now consisting of printed label 17 and plastic overlay 19) on a suitable surface. The exposed overlapping inner surface edges of overlay 19 are coated with adhesive, and the back surface of label 17 is also coated with adhesive, so the final label assembly can be pressed against the chosen mounting surface and sealed thereto to prevent intrusion of moisture or dirt and to prevent smearing of the marks produced on the information surface of label 17.

The multi-layer label system shown in the drawings can be most economically manufactured utilizing a continuous back sheet and a continuous separator sheet. The continuous separator sheet has an inner surface at least partially coated with pressure-sensitive marking material, as generally indicated by reference numeral 23 in the drawings.

The labels such as 17 are then positioned on and adhesively attached to the continuous back sheet. This operation can be performed using conventional machinery well known to those skilled in the art. Next, the continuous separator sheet is aligned with and positioned to cover the major portion of the information surfaces of the respective labels, but leaving an edge strip area (such as area 24 of FIG. 2) of each label exposed. The pressure-sensitive marking material (as indicated by reference numeral 23 in FIGS. 2 and 3) such as 23 is placed against the repsective information surfaces of the previously positioned labels. A plurality of transparent overlays, each having an adhesive inner surface, then is aligned with and positioned on the assembly so that the overlay adheres to the exposed edge strip areas 24 of the labels, the exposed portions of the continuous backing sheet and the outer surface of the continuous separator sheet. Next, the perforations, such as those indicated by line 15 in FIG. 2, may be produced in the continuous separator sheet and the continuous backing sheet. Alternatively, instead of producing the perforations, the multi-layer label assembly can be die cut to provide a plurality of individual multi-layers labels.

Machinery well known to those skilled in the art can be utilized for performing the above manufacturing operations to produce the multi-layer label system 10 shown in the drawings, and is not described herein.

It will be obvious to those skilled in the art that various modifications may be made in the arrangement of elements and steps within the scope of the invention. Therefore, it is intended that the present invention be limited only by the scope of the claims appended hereto.

I claim:

1. A multi-layer label system comprising in combination:

(a) a transparent cover sheet having an inside surface and an outside surface, and having a pressure-sensitive adhesive on said inside surface;

(b) a removable separator sheet releasably contacting said pressure-sensitive adhesive on said inside surface of said transparent cover sheet;

(c) a label having an information surface facing said separator sheet and a back surface having a pressure-sensitive adhesive thereon;

(d) a removable back sheet releasably adhering to the pressure-sensitive adhesive on said back surface of said label;

(e) pressure-sensitive marking means disposed on said separator sheet for producing marks on said information surface in response to marking pressure applied to the outside surface of said transparent cover sheet; and (f) said transparent cover sheet being releasably secured along one edge thereof to said back sheet, said transparent cover sheet being secured to said label along an edge thereof adjacent to said edge of said transparent cover sheet;

whereby said information surface can be effectively marked without folding back said transparent cover sheet and said pressure-sensitive means from said information surface of said label.

2. The multi-layer label system of claim 1 wherein said pressure-sensitive marking means includes a first pressure-sensitive paper and said information surface of said label includes a second pressure-sensitive paper cooperating with said first pressure-sensitive paper to produce a corresponding mark on said information surface in response to said marking pressure.

3. The multi-layer label system of claim 2 wherein said transparent cover sheet is formed from self-adhesive mylar.

4. The multi-layer label system of claim 1 wherein said transparent cover sheet is larger than said label and extends beyond said label on all sides.

5. The multi-layer label system of claim 4 wherein said pressure-sensitive marking means includes a spot carbonized region disposed on an inside surface of said removable separator sheet over a portion of said information surface wherein information is to be marked.

6. The multi-layer label system of claim 4 wherein said label is composed of self-adhesive white sulfite paper.

7. The multi-layer label system of claim 6 wherein said removable separator sheet is formed from silicone treated paper.

8. The multi-layer label system of claim 6 wherein said removable back sheet is formed from silicone treated paper.

* * * * *